US007032791B2

(12) United States Patent
Stotts

(10) Patent No.: US 7,032,791 B2
(45) Date of Patent: Apr. 25, 2006

(54) ALL PLASTIC CLIP

(75) Inventor: Lawrence R. Stotts, Elgin, IL (US)

(73) Assignee: The Clip Company, Keysville, UT (US)

( * ) Notice: Subject to any disclaimer, the term of this patent is extended or adjusted under 35 U.S.C. 154(b) by 351 days.

(21) Appl. No.: 10/676,920

(22) Filed: Oct. 1, 2003

(65) Prior Publication Data

US 2005/0072822 A1 Apr. 7, 2005

(51) Int. Cl.
*A45F 5/02* (2006.01)

(52) U.S. Cl. ..... 224/269; 224/669; 224/930

(58) Field of Classification Search ..... 224/269, 224/271, 197, 666, 668, 669, 930; 24/3.12
See application file for complete search history.

(56) References Cited

U.S. PATENT DOCUMENTS

| | | | | |
|---|---|---|---|---|
| 5,274,885 | A * | 1/1994 | Hellweg | 24/3.12 |
| 5,597,102 | A | 1/1997 | Saarikko et al. | 224/197 |
| 5,730,342 | A | 3/1998 | Tien | 224/271 |
| 5,779,115 | A * | 7/1998 | Parkas et al. | 224/272 |
| 5,833,100 | A | 11/1998 | Kim | 224/197 |
| 5,850,954 | A | 12/1998 | Dong-Joo | 224/197 |
| 5,850,996 | A | 12/1998 | Liang | 248/221.11 |
| 5,927,580 | A | 7/1999 | Ward-Llewellyn | 224/272 |
| 6,006,969 | A | 12/1999 | Kim | 224/197 |
| 6,205,222 | B1 | 3/2001 | Carpenter | 379/446 |
| 6,223,788 | B1 * | 5/2001 | Choy et al. | 24/3.12 |
| 6,283,348 | B1 * | 9/2001 | Wang | 224/271 |
| 6,286,737 | B1 * | 9/2001 | Whitley | 224/271 |
| 6,443,340 | B1 | 9/2002 | Chung et al. | 224/197 |
| D478,418 | S | 8/2003 | Badillo et al. | D3/218 |
| 6,714,767 | B1 * | 3/2004 | Fan | 455/90.3 |
| 6,736,136 | B1 * | 5/2004 | Chen-Lieh | 128/201.11 |
| D492,108 | S | 6/2004 | Goradesky | D3/218 |
| 6,824,028 | B1 * | 11/2004 | Mutai et al. | 224/271 |
| 6,955,279 | B1 * | 10/2005 | Mudd et al. | 224/197 |
| 6,955,280 | B1 * | 10/2005 | Saitoh et al. | 224/269 |
| 2001/0054217 | A1 * | 12/2001 | Wang | 24/3.1 |
| 2002/0158096 | A1 * | 10/2002 | Wang | 224/271 |
| 2002/0170148 | A1 | 11/2002 | Mayne et al. | 24/3.12 |
| 2003/0000976 | A1 * | 1/2003 | Malhotra | 224/197 |
| 2003/0047575 | A1 | 3/2003 | Enkerlin et al. | 224/271 |
| 2003/0141329 | A1 * | 7/2003 | Huang | 224/197 |
| 2003/0162510 | A1 | 8/2003 | Kim | 455/90 |
| 2004/0204169 | A1 | 10/2004 | Goradesky | 455/569.1 |

FOREIGN PATENT DOCUMENTS

| | | |
|---|---|---|
| EP | 0910971 | 4/1999 |
| JP | 02002136322 A * | 5/2002 |

* cited by examiner

*Primary Examiner*—Nathan J. Newhouse
*Assistant Examiner*—Justin M. Larson
(74) *Attorney, Agent, or Firm*—Drinker Biddle & Reath LLP

(57) ABSTRACT

An all plastic clip for a portable electronic device is described. The clip includes a housing having a cradle for receiving a flange attached to the portable telephone and a back plate closing the housing. A latch inside the housing includes a detent extending through an orifice in the housing wall into the cradle. The latch release includes a release button disposed in an opening in the top of the housing. A displacement tine extends from the release button and includes a displacement ramp for interacting with a lifting slope on the latch. A resiliently flexible tongue also extends to the latch. In use, the release button is pushed and the displacement ramp interacts with the lifting slope to displace the latch and release the device. When the release button is released, the resiliently flexible tongue urges the latch back into the locking position.

18 Claims, 6 Drawing Sheets

ALL PLASTIC CLIP

FIELD OF THE INVENTION

The invention relates to the field of portable electronic devices and specifically to clips for attaching such devices to a user's belt or other convenient object.

BACKGROUND OF THE INVENTION

Over the past twenty years, portable electronic devices have become very popular. Well known portable devices include personal stereo equipment, navigational aids and communications devices, such as pagers and telephones. Such devices are frequently clipped onto a user's belt or to a convenient nearby object to eliminate the need for the user to hold the device while moving about.

Most recently, portable telephones, including home-based portable telephones, cellular telephones and satellite telephones have become common place. The term "portable telephone" is meant to include all such devices. The United States Federal Communications Commission (FCC) defines portable devices as transmitters whose radiating structures are designed to be used within 20 centimeters of the body of the user. Such portable devices are differentiated from "mobile devices", which are generally those non-fixed transmitters that are used in such a way that the radiating structure is normally more than 20 centimeters away from the user or others.

Conventional clips for portable telephones and other electronic devices include a housing with an attached cradle for receiving a flange-type mount fixed to the device or carrying bag, such as that shown in U.S. Pat. No. 5,597,102 to Saarikko et al. The cradle is generally open at the top, but includes side and bottom walls and a front wall with a vertical center slot for receiving the mount. The conventional clips further include a latch protruding through an opening in the housing into the cradle. The latch is typically biased forward into the cradle by a metal coil spring. A release button can include legs or tines with biasing surfaces to withdraw the latch from the cradle when the release button is pushed downwardly. When the release button is no longer pushed, a second metal spring can bias the release button back to its upward position, while the first spring biases the latch back into the cradle.

A problem with such conventional clips is that the metal springs can wear out or fail. Another problem is that metal springs can affect electromagnetic fields near the device that is being supported by the clip. The second problem can lead to significant expense because the FCC requires that many portable telephones be tested for radio frequency (RF) exposure to a potential human user. It is common to test such devices for specific absorption rate (SAR) of RF radiation, which under FCC guidelines should be limited to 1.6 watts/kg, as averaged over one gram of tissue. In evaluating compliance with the SAR guidelines, portable devices should be tested based on normal operating conditions. Thus, if the device is to be used in conjunction with a clip, the clip too should be involved with the test. This testing adds significant expense to the manufacture of portable devices.

A need exists for a clip for portable devices that includes no metal springs and, consequently, will not affect a device's SAR or require the device and the clip to be tested.

SUMMARY OF THE INVENTION

The invention relates to an all plastic or otherwise metal-free clip for an electronic device, such as a portable telephone. The clip includes a housing having a cradle for receiving a flange attached to the electronic device. An orifice in the housing wall communicates with the cradle and the interior of the housing. An opening for a release button is formed in the top of the housing. A back plate is snapped into place to close the housing.

A latch inside the housing includes a detent extending through the orifice into the cradle. The latch includes one or more lifting slopes for interacting with a latch release. The latch release includes a release button disposed in the housing opening. The latch release further includes one or more displacement tines extending from the release button to the lifting slopes, each displacement tine having a displacement ramp interacting with one of the lifting slopes. The latch release also includes a resiliently flexible tongue extending to the latch for urging the detent of the latch into the cradle.

In use, when the release button is pushed, the displacement ramp interacts with the lifting slope to displace the latch out of the position in which the detent extends into the cradle. When the release button is not pushed, the resiliently flexible tongue urges the latch back into the position in which the detent extends into the cradle.

DEFINITIONS

The term "proximal" refers to the portion of a belt clip or clip component that is closer to a user's body than another portion or component when the belt clip is properly affixed to the user's belt.

The term "distal" refers to the portion of a belt clip or clip component that is farther from the user's body than another portion or component when the belt clip is properly affixed to the user's belt.

The term "left" is used to reference the left side of a clip when the clip is viewed from the proximal side and the clip is oriented with the release button at the top.

The term "right" is used to reference the right side of a clip when the clip is viewed from the proximal side and the clip is oriented with the release button at the top.

The terms "up" or "upwardly" refer to that which is toward the release button of the clip.

The terms "down" or "downwardly" refer to that which is away from the release button of the clip.

BRIEF DESCRIPTION OF THE DRAWINGS

For the purpose of illustrating the invention, there is shown in the drawings a form which is presently preferred; it being understood, that this invention is not limited to the precise arrangements and instrumentalities shown.

DETAILED DESCRIPTION OF THE DRAWINGS

Figure 1:
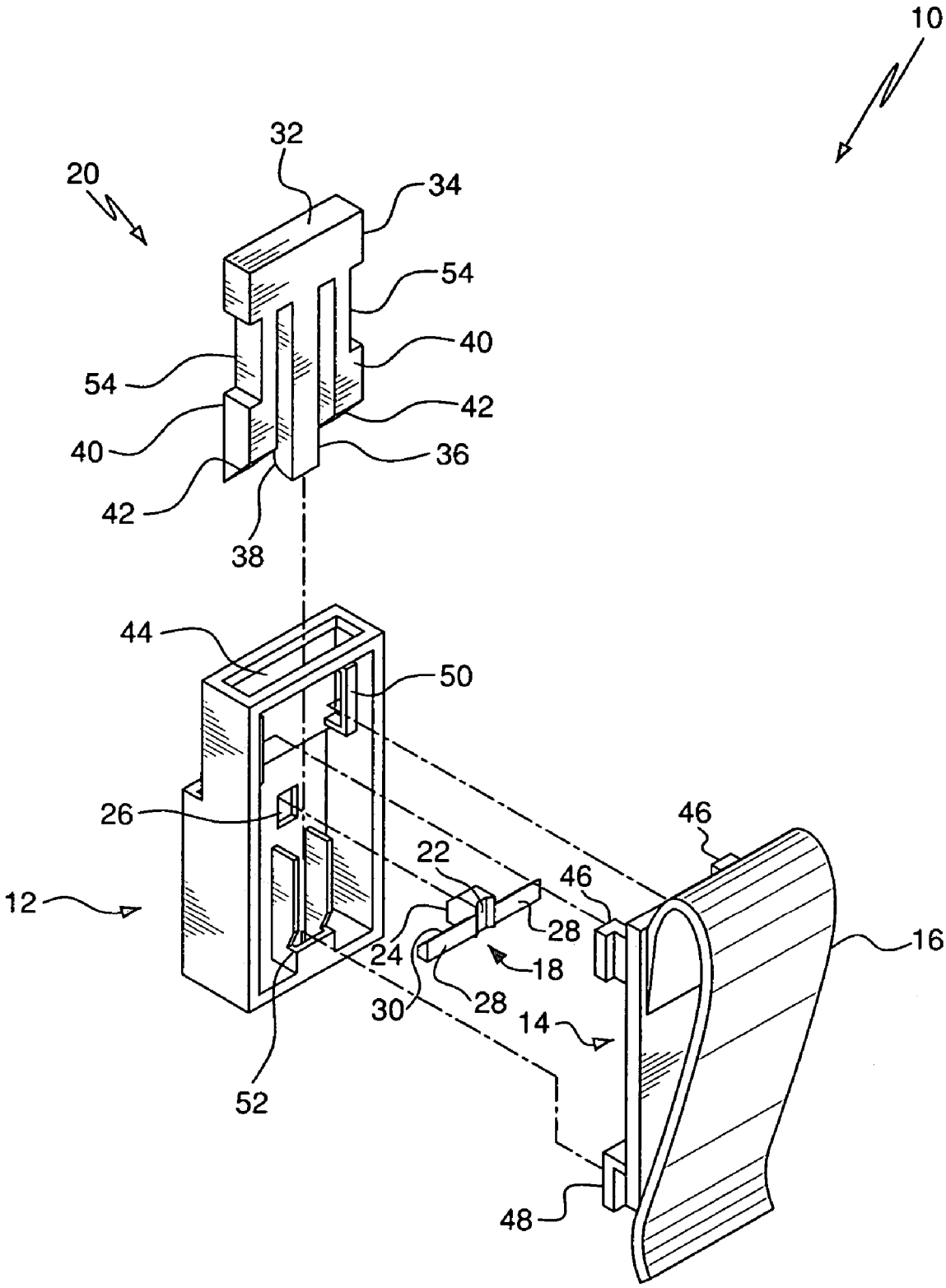
FIG. 1 is an exploded view of a belt clip according to the present invention.
Figure 2:
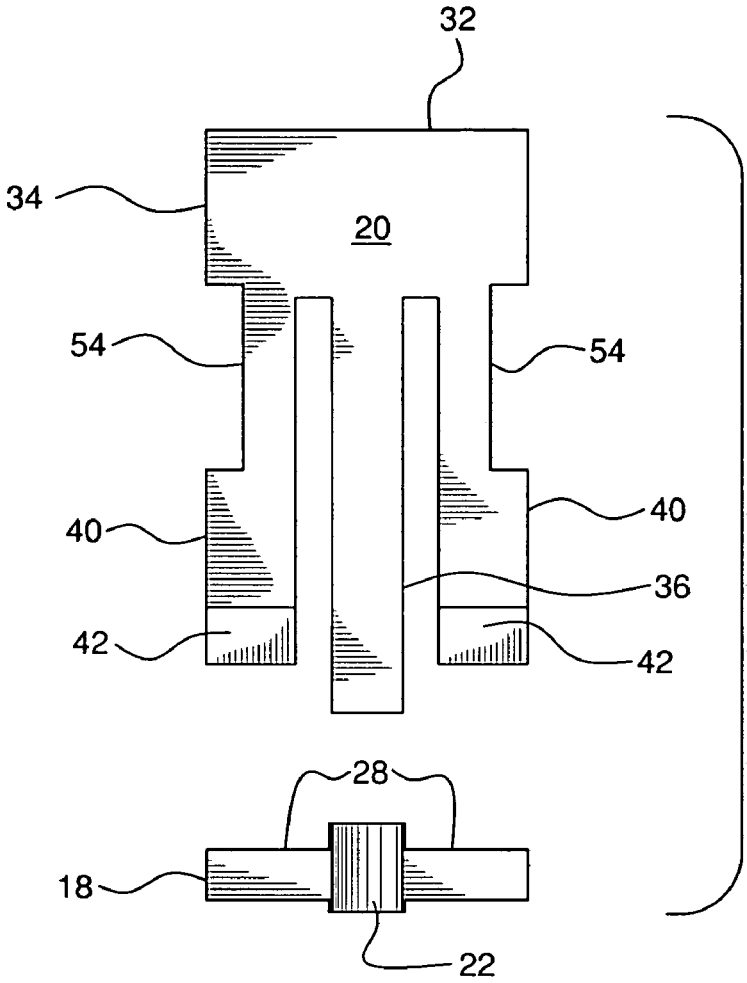
FIG. 2 is a view of the proximal surfaces of a latch and a latch release of the belt clip of FIG. 1.
Figure 3:
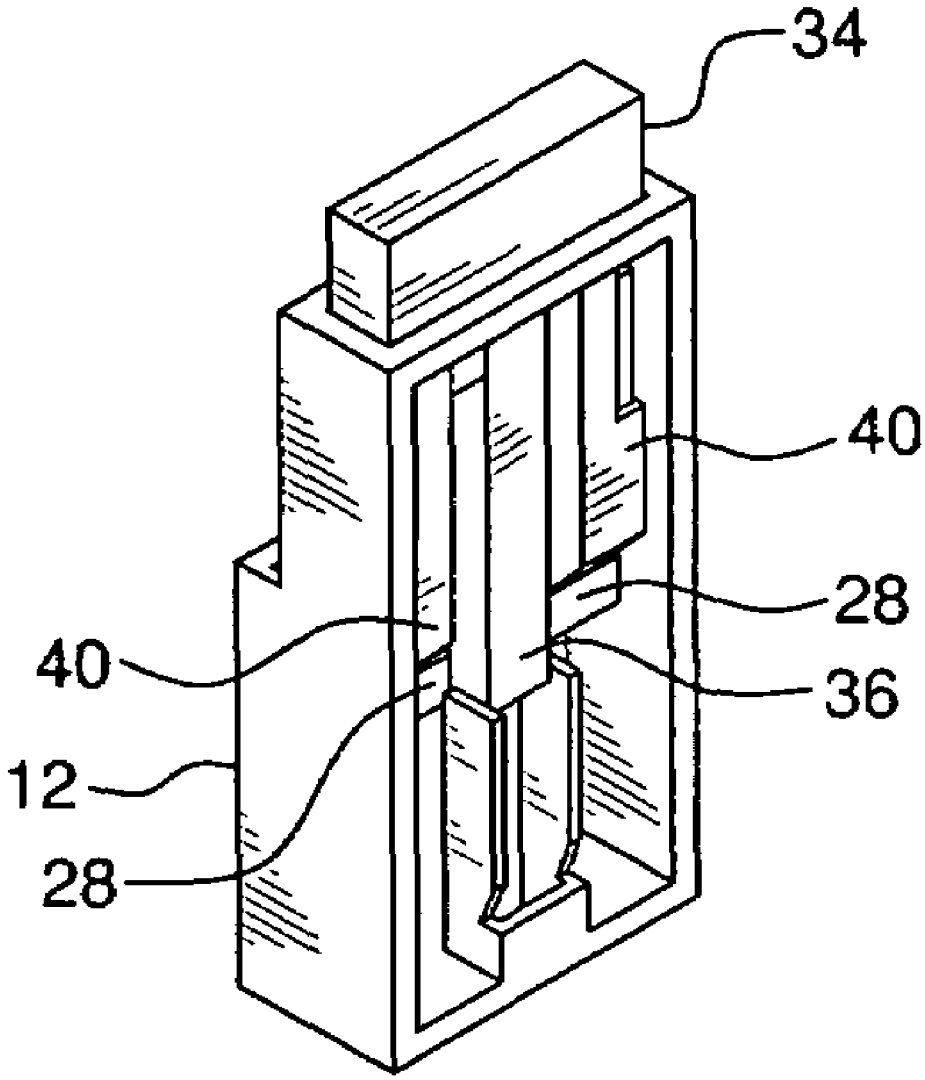
FIG. 3 is an isometric view of the latch and latch release positioned within the housing of the belt clip of FIG. 1 as seen from the proximal and left sides.

In the Figures, in which like reference numerals indicate like elements, there is shown a preferred embodiment of an all plastic clip 10. The clip 10 is of the type for engaging a portable electronic device such as a portable telephone, PDA, MP3 Player, Portable disk player, WALKMAN, GPS system, hand held Palm Device, or a case for carrying such a device. The clip 10 can be used to affix any such device having an appropriate attachment flange to a user's belt. Being formed from non-metallic components, the clip lacks a metal spring for biasing the latching mechanism. All of the components of the clip 10 can be made from the same non-metallic material, preferably plastic. Each of the components can be made by injection molding.

The clip 10 includes a housing 12 and a back plate 14 having a belt-engaging hook 16 affixed to its proximal surface. Instead of the belt-engaging hook 16, the back plate can be equipped with other means for attaching the clip to a desired object, such as a strip of plastic, which has a spring clip at one end and is attached at the other end to the back plate 14 by a rivet for allowing rotation about a horizontal axis. Other means that can be used include those shown in U.S. Pat. App. Publication No. 2003/0162510 A in the name of Kim. The housing 12 and back plate 14 include snapping members for attaching the back plate 14 to the housing. The clip further includes a latch 18 and a latch release 20.

The latch 18 and latch release 20 are shown in large scale in FIGS. 2 and 4–6. The latch 18 includes a central portion with a tongue-engaging surface 22 on its proximal surface. The tongue-engaging surface 22 is preferably a rounded groove or trapezoidal channel in which a tongue can slide in the up-down direction. The distal side of the central portion includes a detent 24, which extends through an orifice 26 in the housing 12 when the clip 10 is assembled properly. The latch 18 further includes a pair of wings 28 extending laterally from the central portion. The distal surface of each wing 28 is tapered to act as a lifting slope 30 when the latch 18 and the latch release 20 are brought into latch-releasing engagement, which will be explained below with regard to FIG. 6. The shape of the proximal surface of the wings 28 is not critical.

The latch release 20 includes a pressing surface 32 at the top of a release button 34. A resiliently flexible tongue 36 extends downwardly from the release button 34. The lower portion of the flexible tongue is preferably provided with a distal surface 38 shaped to correspond with and ride in the tongue-engaging surface 22 of the latch 18. Where the tongue-engaging surface 22 is a rounded groove, the lower portion of the distal surface 38 should be correspondingly rounded. Displacement tines 40 extend downwardly from the release button 34 on each side of the flexible tongue 36. The end of each displacement tine 40 is tapered on its proximal surface to provide a displacement ramp 42 that corresponds with the lifting slope 30 on the distal surface of each latch wing 28.

It should be noted that according to the preferred embodiment, the latch release 20 is integrally formed of unitary construction as shown in the drawings. However, it may also be possible to produce the latch release 20 in two or more parts. For example, the latch release could be molded as two distinct parts and the resiliently flexible tongue 36 subsequently attached to the release button 34, housing 12 or back plate 14, or the resiliently flexible tongue 36 could be molded integrally as part of the housing or back plate. However, in any of these alternative configurations, an important consideration is that the resiliently flexible tongue 36 be appropriately positioned to urge the latch 18 into a position in which the detent 24 extends through the orifice 26 as explained below.

Figure 4:
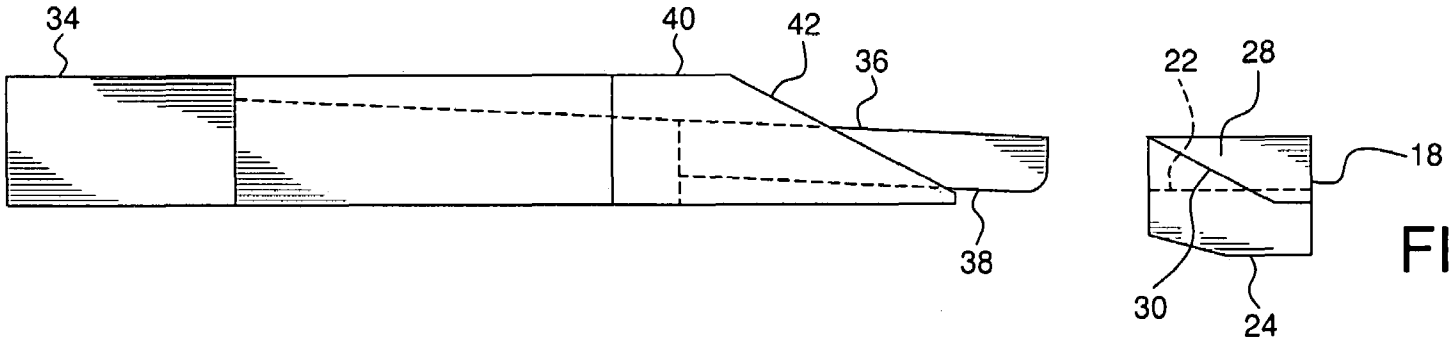
FIG. 4 is a left side view of the latch and latch release while the components are not engaged.
Figure 5:
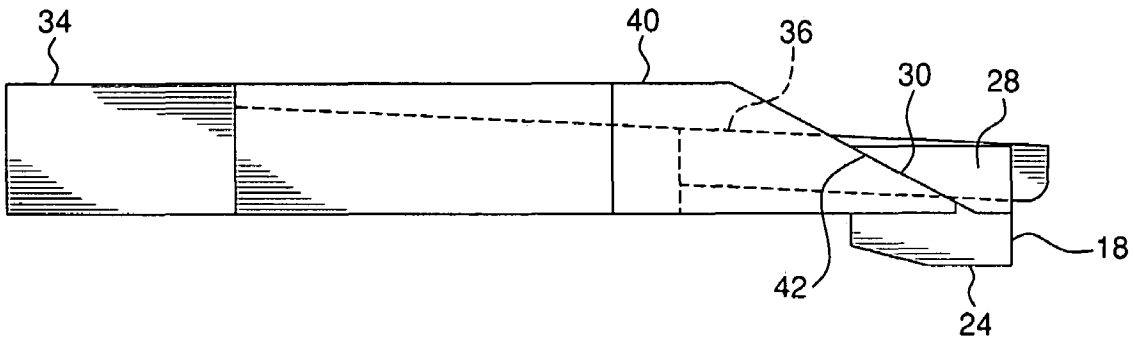
FIG. 5 is a left side view of the latch and latch release while the components are in resting engagement.
Figure 6:
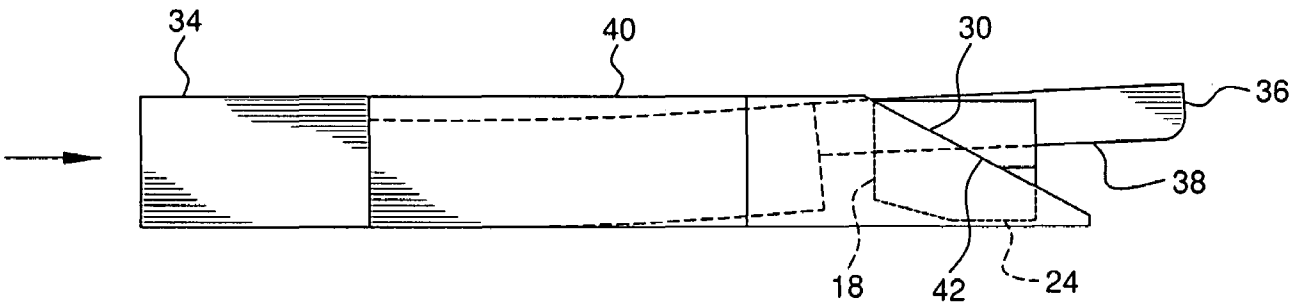
FIG. 6 is a left side view of the latch and latch release while the components are in latch-releasing engagement.

It should be noted that the displacement tines 40 are thicker than the flexible tongue 36 in the proximal-distal direction, as shown in FIGS. 4–6. The thickness of the flexible tongue 36 permits it to flex proximally when a displacement force is applied thereto and to resiliently flex distally when the force is removed. The flexibility of the displacement tines 40 is not critical because movement of the displacement tines 40 is generally restricted once the clip has been assembled as explained further below.

Figure 7:
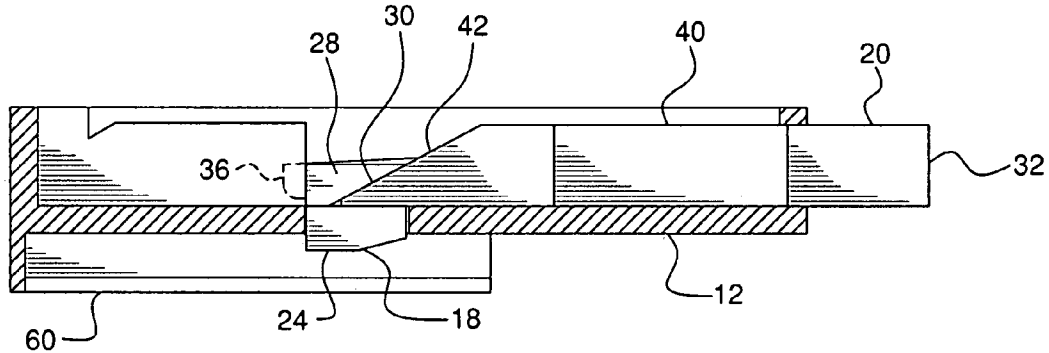
FIG. 7 is a right side view of the resting engagement of the latch and latch release as seen through a longitudenal cross-section of the housing.

The components can be assembled by inserting the detent 24 of the latch 18 through the orifice 26 in the housing 12. The latch release 20 can be inserted through an opening 44 in the top of the housing 12 so that the resiliently flexible tongue 36 and displacement tines 40 extend downwardly into the housing 12. The flexible tongue 36 engages the proximal surface of the central portion of the latch 18 so that the distal surface 38 rides along the tongue-engaging surface 22. The displacement tines 40 meet the latch wings 28 so that the displacement ramps 42 on the proximal surfaces of the displacement tines 40 engage the lifting slopes 30 on the distal surfaces of the wings 28. Absent outside influence, the latch release 20 and latch 18 tend to take a resting position where the flexible tongue 36 of the latch release 20 holds the latch 18 against the wall of the housing so that the detent 24 extends through the orifice 26 as shown in FIG. 7.

With the latch release 20 and latch 18 in the resting position, assembly of the clip 10 can be completed by snapping the back plate 14 into place to close the housing 12. The back plate 14 includes upper snapping members 46 and lower snapping member 48 that engage respective snapping receivers 50, 52 in the housing. It should be noted that the displacement tines 40 of the latch release 20 include recesses 54 in their respective lateral surfaces. The snapping members 46 are spaced apart from one another so as to fit within the recesses 54 when the back plate 14 is snapped into place on the housing. However, the end portions of the displacement tines 40 and the release button 34 are too wide to fit between the snapping members 46. The length (up-down dimension) of the snapping portions 46 is less than the length of the recesses 54 into which the snapping members 46 fit.

Thus, once assembled, the snapping members 46 permit movement of the latch release 20 further into and out of the housing (up-down direction), but restrict freedom of movement so that the latch release 20 can not travel too deeply into the housing or be withdrawn fully back through the opening 44. In addition, the distal surface of the back plate 14 and the wall of the housing prevent significant movement of the displacement tines 40 proximally and distally with respect to the housing. (Insignificant movement of the displacement tines 40 in the proximal-distal direction is acceptable.) However, the flexible tongue 36 is free to resiliently flex proximally when influenced by a displacement force.

As shown in FIGS. 4–6, the flexible tongue 36 is preferably disposed at a distal slope as it extends away from the release button 34. The flexible tongue 36, riding in the tongue-engaging surface 22 on the distal surface of the latch 18, tends to hold the latch 18 against the wall of the housing with the detent 24 extending through the orifice 26.

Figure 9:
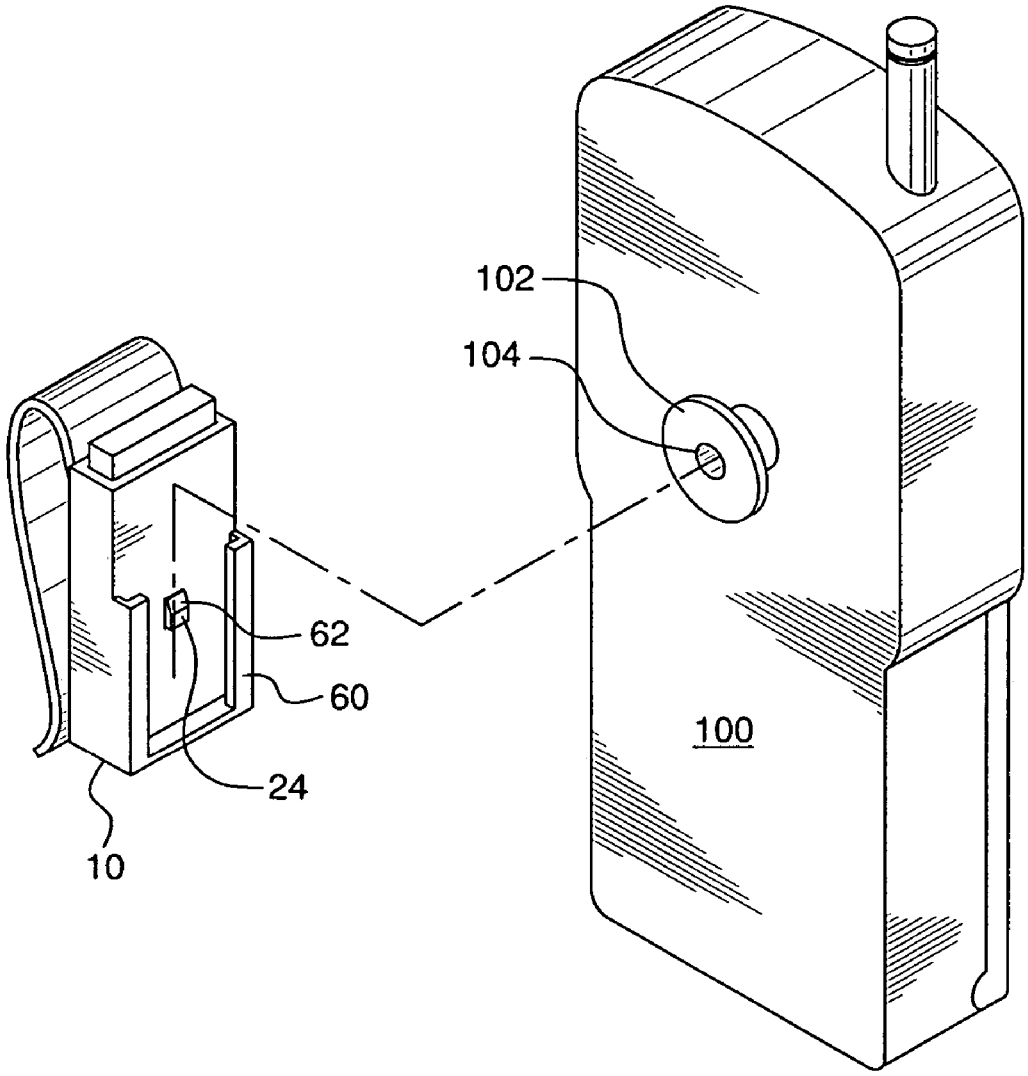
FIG. 9 is a view of the proximal surface of a portable telephone in association with the distal surface of the assembled clip of the present invention.

In use, a portable telephone 100 or other device can be snapped into a cradle 60 on the distal portion of the housing 12. (Portable telephone 100 is shown in FIG. 9 merely as an exemplary device for attaching to the clip 10, but is not part of the present invention.) The telephone 100 can be equipped with a cradle engaging flange 102 by affixing the flange to the back of the telephone, or by placing the telephone in a carrying pouch equipped with such a flange 102, both of which methods are known in the art. The detent 24 of the latch 18 can have a tapered surface 62 so that the flange 102 can displace the latch 18 proximally when the flange 102 is placed in the cradle 60. The displacement of the latch 18 in turn displaces the resiliently flexible tongue 36 proximally. When the flange 102 is properly positioned in the cradle 60, the flexible tongue 36 urges the detent 24 distally into a recess 104 in the flange 102 and locks the telephone 100 or other device in place. When so locked, the latch 18 and latch release 20 are in the resting engagement of FIG. 7. (The back plate 14 and flange 102 are not shown in FIG. 7.)

Figure 8:
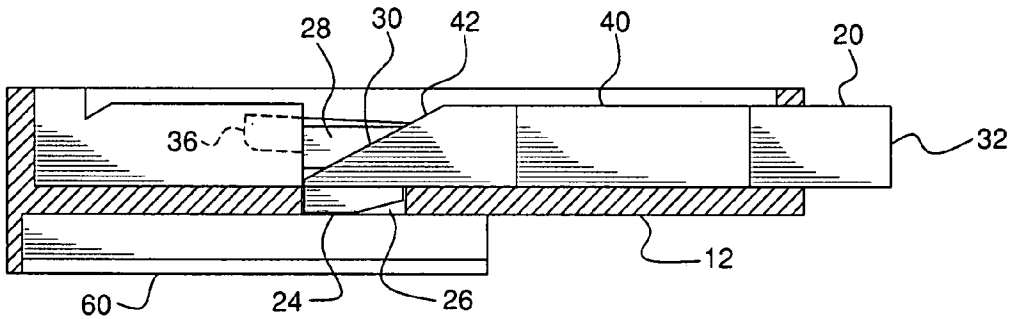
FIG. 8 is a right side view of the latch-releasing engagement of the latch and latch release as seen through a longitudenal cross-section of the housing.

When the user desires to release the telephone 100, the user can push downwardly on the pressing surface 32 to force the latch release 20 downwardly (further into the housing) as shown in FIG. 8. (The back plate 14 and tab 102 are not shown in FIG. 8.) As the latch release 20 is pushed downwardly, the displacement ramps 42 slide along the lifting slopes 30 on the distal surfaces of the latch wings 28. The interaction between the displacement ramps 42 and lifting slopes 30 displaces the latch 18 proximally to the position shown in FIG. 8, in which the latch 18 and latch release 20 are in latch-releasing engagement. In this position, the detent 24 is withdrawn into the housing and does not extend significantly past the orifice 26. Therefore, the flange 102 (and telephone 100 or other device) can be removed from engagement with the cradle 60.

When the user releases the pressing surface 32 of the release button 34, the resiliently flexible tongue 36 tends to flex distally to resume its resting position. Distal flexing of the flexible tongue 36 urges the latch 18 distally. As the latch 18 is so urged, the interaction of the lifting slopes 30 and displacement ramps 42 pushes the latch release 20 upwardly to the position shown in FIG. 7, in which the latch 18 and latch release 20 are again in resting engagement, with the detent 24 once again extending through the orifice 26.

A variety of modifications to the embodiments described will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A clip for engaging a flange attached to a portable electronic device to enable the device to be attached to a desired object, the clip comprising:

a housing comprising a housing wall and a cradle for receiving the flange;

a back plate having on a proximal side thereof means for attaching the clip to an object;

a latch comprising a detent extending through an orifice in the housing wall into the cradle, a wing having a distal surface with a lifting slope, and a tongue-engaging surface on a proximal side; and a latch release comprising a release button, a resiliently flexible tongue extending downwardly from the release button and engaging the tongue-engaging surface of the latch, displacement tine extending downwardly from the release button, the displacement tine having a displacement ramp on a proximal surface, the displacement ramp engaging the lifting slope of the wing;

wherein the displacement ramp interacts with the lifting slope to displace the latch proximally when the release button is pressed, and the resiliently flexible tongue urges the latch distally when the release button is not pressed.

2. The clip of claim 1 wherein the means for attaching the clip to an object comprises a belt-engaging hook.

3. The clip of claim 1 wherein the housing, back plate, latch and latch release consist essentially of non-metallic material.

4. The clip of claim 1 wherein the housing, back plate, latch and latch release consist essentially of plastic.

5. The clip of claim 1 wherein the resiliently flexible tongue extends centrally down the housing and the tongue-engaging surface is on the proximal side of the central portion of the latch.

6. The clip of claim 5 wherein the latch release comprises a displacement tine extending downwardly on each side of the resiliently flexible tongue, each displacement tine having a displacement ramp engaging a lifting slope on each of two wings extending laterally from the central portion of the latch.

7. A metal-free clip for a portable telephone or other electronic device, the clip comprising:

a housing comprising a cradle for receiving a flange attached to the device, and a housing wall with an orifice communicating with the cradle and an interior of the housing;

a back plate closing the housing, the back plate being attached to a belt-engaging hook;

a one-piece latch comprising a central portion having a detent on a distal surface extending through the orifice into the cradle, a tongue-engaging surface on a proximal surface of the central portion, and a pair of wings extending laterally from the central portion, each wing having a lifting slope on its distal surface; and a one-piece latch release comprising a release button disposed in an orifice in the top of the housing, a central, resiliently flexible tongue extending downwardly into the housing from the release button, the lower portion of the flexible tongue riding along the tongue-engaging surface of the latch, a pair of displacement tines extending downwardly into the housing from the release button, the lower portion of each displacement tine having a displacement ramp on the proximal surface interacting with the lifting slope of one of the wings.

8. The metal-free clip of claim 7 wherein each component consists essentially of plastic.

9. The metal-free clip of claim 7 wherein the displacement ramps interact with the lifting slopes of the wings to displace the latch proximally and withdraw the detent from the cradle when the release button is pressed, and the flexible tongue urges the latch distally to extend the detent into the cradle when the release button is not pressed.

10. The metal-free clip of claim 7 wherein the tongue-engaging surface of the latch comprises a groove in which the lower portion of the flexible tongue rides.

11. An all plastic clip comprising:

a housing comprising a cradle for receiving an attachment to a portable electronic device, an orifice in a housing wall communicating with the cradle, and an opening for a release button;

a back plate closing the housing;

a latch inside the housing comprising a lifting slope and a detent extending through the orifice into the cradle; and a latch release comprising a release button disposed in the opening, a displacement tine extending from the release button to the lifting slope, the displacement tine having a displacement ramp interacting with the lifting slope, and a resiliently flexible tongue biasing the latch into a position in which the detent extends into the cradle;

wherein, when the release button is pushed, the displacement ramp interacts with the lifting slope to displace the latch out of the position in which the detent extends into the cradle.

12. The all plastic clip of claim 11 wherein the latch release is integrally formed of one-piece construction.

13. The all plastic clip of claim 11 wherein the resiliently flexible tongue extends from the release button to a central portion of the latch and rides along a tongue-engaging surface of the latch.

14. The all plastic clip of claim 13 wherein the latch release comprises a pair of displacement tines, one of the displacement tines extending from the release button on each side of the resiliently flexible tongue.

15. The all plastic clip of claim 13 wherein the detent is disposed on the central portion of the latch on the opposite side of the tongue-engaging surface.

16. The all plastic clip of claim 11 wherein the detent is disposed on a central portion of the latch, the latch further comprising a pair of wings extending laterally from the central portion, each wing having a lifting slope.

17. The all plastic clip of claim 16 wherein the resiliently flexible tongue extends from the release button to the side of the central portion opposite the detent.

18. The all plastic clip of claim 17 wherein the latch release comprises a pair of displacement tines, one of the displacement tines extending from the release button on each side of the resiliently flexible tongue, and the displacement ramp of each displacement tine interacting with one of the lifting slopes of one of the wings.

* * * * *